United States Patent [19]

Stefaniak

[11] 4,131,992

[45] Jan. 2, 1979

[54] METHOD OF RE-CONDITIONING MAT SWITCHES

[75] Inventor: James L. Stefaniak, Greenfield, Wis.

[73] Assignee: S & H Moonlight Design Industries, Inc., St. Francis, Wis.

[21] Appl. No.: 830,726

[22] Filed: Sep. 6, 1977

[51] Int. Cl.[2] ..... H01H 11/00

[52] U.S. Cl. ..... 29/622; 29/401 R; 29/401 F; 29/593

[58] Field of Search ..... 29/401 R, 401 F, 622, 29/593

[56] References Cited

U.S. PATENT DOCUMENTS

| | | | |
|---|---|---|---|
| 2,951,921 | 9/1960 | Wikkerink | 200/86 |
| 3,056,005 | 9/1962 | Larson | 200/86 |
| 3,323,197 | 6/1967 | Millard | 29/622 |
| 3,581,391 | 6/1971 | Shaver | 29/622 |
| 3,722,086 | 3/1973 | Wikkerink et al. | 29/622 |

*Primary Examiner*—Victor A. DiPalma

*Attorney, Agent, or Firm*—Wheeler, Morsell, House & Fuller

[57] ABSTRACT

An existing worn out floor mat electric switch is reconditioned by cutting it on three sides, severing the electric cord in two places, removing the inner parts of the mat switch, drilling out the metallic portions of the line cord, cleaning the contactor plates, inserting and reconnecting a new line cord, supplying new contractor buttons and separator strips, and reassembling and resealing the mat.

8 Claims, 5 Drawing Figures

METHOD OF RE-CONDITIONING MAT SWITCHES

BACKGROUND OF THE INVENTION

Floor mat switches such as those used to operate doors at supermarkets are subjected to a great deal of abuse and wear because of their location. The result is that they are quite apt to fail. At present such mats are not repaired but are simply discarded and replaced. It is an object of this invention to provide an efficient and effective way of rebuilding such floor mat switches in such a manner as to restore substantially the original functioning. In some instances the restored mat is actually an improvement over the original.

SUMMARY OF THE INVENTION

Our rebuilding method comprises the steps of making a cut at a 45° angle to the vertical along the three sides of the mat which do not contain the electrical cord with the cut extending into the space between the upper and lower metal plates which are the contacts of the floor mat switch, opening the mat to an angle of up to 135°, removing the plates and separator materials, cleaning the top and bottom contact sheets, removal of the old cord by cutting it outside the envelope and inside the envelope without cutting the envelope itself, and drilling out the wires, insertion of new wires into the drilled holes and securing the new cord wires to the respective plates, and re-assembly of the plates with separator buttons and strips. The cord is sealed inside and outside at the point of entry preferably using a solvent sealer such as VC-2 and liquid vinyl plastisol, heat cured, and the mat is closed and sealed, preferably with a heated plastic welding gun.

The mat is welded closed on the three cut sides using an electric plastic welder such as a Seelye with Model 63 accessories and coiled PVC welding cord. The weld is then leveled mechanically and is finally heated again using the plastic welding machine and rolled smooth with a metal roller. Nitrogen is then used to inflate the mat by injecting it with a needle. The mat is then submerged and inspected, rewelded with plastic solvent, exhausted until the mat regains its normal thickness, and the opening sealed. In the event that electrical tests of the mat show any defects this process may be repeated before sealing. The mat may then be finished with conventional paints and lacquers for this purpose.

DRAWINGS

DETAILED DESCRIPTION OF THE INVENTION

Figure 1:
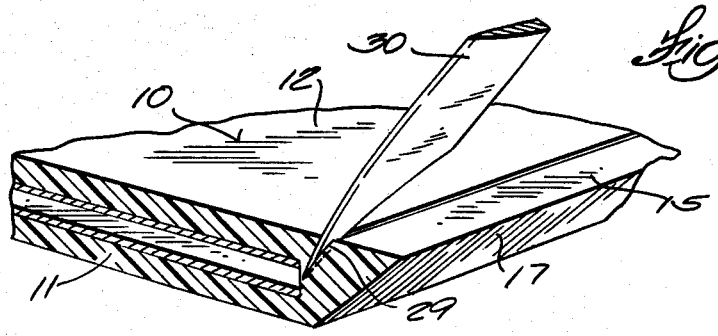
FIG. 1 is an inverted door mat of conventional construction showing the manner in which the opening cut is made.
Figure 2:
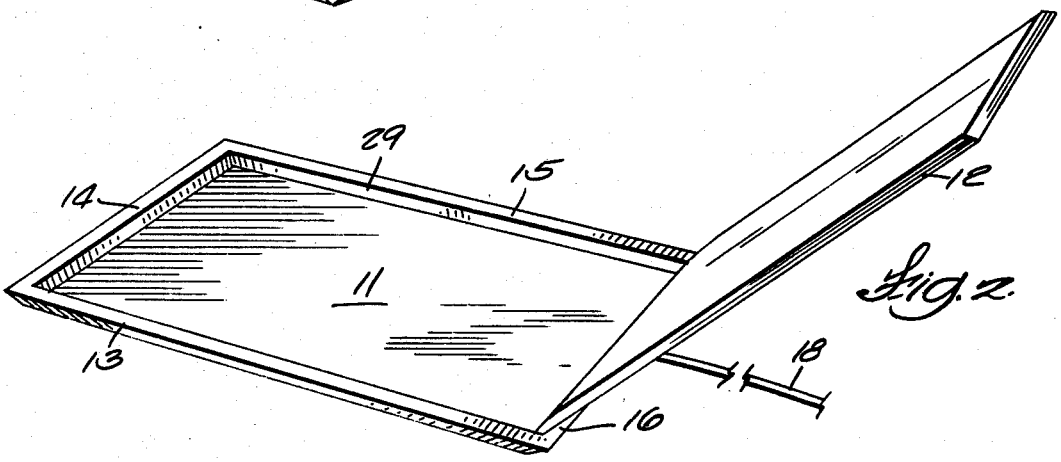
FIG. 2 is a perspective view of a door mat in which the cut has been made and the cover opened to its maximum extent and the contents removed.
Figure 3:
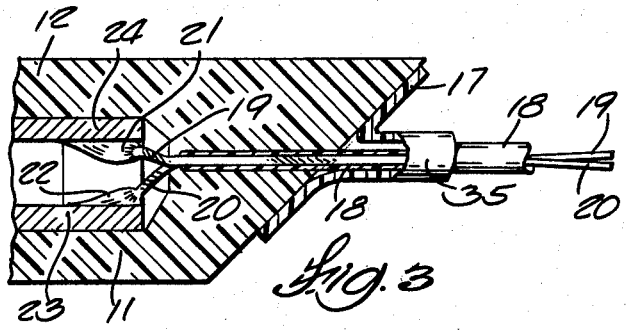
FIG. 3 is a cross sectional view through the margin of the mat at the cord.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

No part of the mat switch described herein is my invention. What I have invented is a method of reconditioning a mat switch which has heretofore been impossible because the operating requirements of the switch are so critical, particularly the requirement that it be completely sealed to prevent the entrance of moisture. The environment in which the switches are used is extremely punishing. In a supermarket entrance thousands of people a day may walk on the switch. Even when the switch is not directly exposed to rain, and many are, pedestrians cross the mat with wet feet or even muddy feet. None of this must affect the reliable operation of the switch. This means that the two large contact plates must be held firmly out of contact until someone steps on the switch at which time they must be firmly in contact. Typical electrical standards require at least a million ohms resistance when the switch is open and substantially zero ohms when the switch is closed. Any failure of the sealing of the external jacket of the switch will very quickly terminate the useful life. While the method of this invention is not limited to a particular floor mat switch, applicant has shown a switch similar to that shown in U.S. Pat. No. 3,821,500 to illustrate the steps in this process.

My process involves the reconditioning of a floor mat switch having a plastic envelope 10 consisting of an upper surface 11, a lower surface 12, and sides 13, 14, 15 and 16 which may or may not have a bevel 17 on each side. A cord 18 having conductors 19 and 20 in a plastic insulating sheath 21 extends through one end of the mat switch. Connectors 19 and 20 are connected at 21 and 22 to electrical contact plates 23 and 24. Separator buttons 25 are placed in a spaced array between contact plates 23 and 24 and strips 26 are placed around the periphery of the space between plates 23 and 24. Buttons 25 may preferably be square for more uniform sensitivity.

The manner in which an old mat switch is opened for reconditioning is very important. A knife 30 is inserted at a corner of a side other than the one occupied by cord 18 at an angle of 45° to the mat surface 12 with the tip between plates 23 and 24 and is drawn the entire length of the side in a straight line as best shown in FIG. 1. This step is repeated for the three sides 13, 14, and 15, but not for side 16 which has cord 18.

The cover is then opened to a maximum of 135° to avoid damage and all interior parts are removed. The cord 18 is severed flush at the inside surface of side 16 and at the outside surface of side 16 and the remaining electric wires 19 and 20 are drilled out for insertion of new wires.

The contact plates are thoroughly cleaned of all separator materials, corrosion, dirt and other materials, and are preferably washed with alcohol and dried with compressed air before reassembly. The spots where the separator buttons 25, which are discs of pure gum rubber, are to be attached to the contact plate are then ground lightly for good adhesion. I find that a glue known as INSTANT KRAZY GLUE performs well in this service and is preferred. The precise composition of that glue is not know to me. Other similar glues do not work as well.

A new electrical cord having a plastic jacket 18 is now inserted in the hole left by drilling out the old cord. These holes should usually be ⅛ inch in diameter and 1/16 inch apart in accordance with normal spacing. The outer jacket of the cord 18 is removed leaving insulation intact on each wire 19 and 20. The wires are inserted through the holes in side 16 of the mat and polyvinyl chloride plastisol is inserted around the insulation of the wire and is then cured by the application of heat.

One method is to clamp a heating element over each of wires 19 and 20 adapted to supply the correct amount of heat for curing. A 27-watt 120-volt heating element with rheostatic temperature control is satisfactory for the purpose. After curing, the heating elements are preferably cooled quickly, for instance with $CO_2$ gas, and then removed. Preferably pressure is applied to the area through which the wires pass during the cure.

An alternative method of curing involves applying pressure with a metal crimping tool and applying heat with a heat gun.

Figure 5:
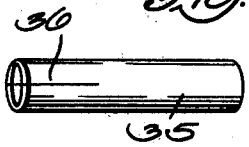
FIG. 5 is a side view of a slit tube used for sealing the new wire into place.
Figure 4:
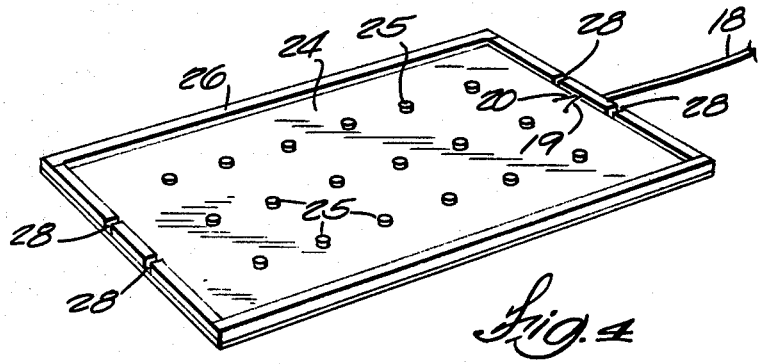
FIG. 4 shows the bottom plate of the mat with the new separators and spacer buttons in position ready for re-assembly.

For additional security against leaks in the cord area I may prepare a piece of flexible polyvinyl chloride tube 35 (FIG. 5) which just fits over the cord 18, by slitting one end at 36 and placing it on the cord before the cord is inserted in the holes in side 16 with the slit area toward the mat (FIG. 4). After the plastisol around the cord has been cured the tube is then slid over the area where the cord cover 18 butts against edge 17 of the mat, with the slit portion separated to lie against the mat surface (whether bevelled, square, or other shape) and heat and pressure are applied to unify the plastic sleeve with the mat material. Liquid PVC plastisol is then added all around the lips of the slit in the tube and the other end of sleeve 35 to the end where vinyl cord cover 18 emerges from it, and again the plastisol is heat cured. Preferably some of the plastisol is injected into the sleeve before the final cure. The curing is carried out under heat and compression and any voids are resealed. After the new cord is properly attached to side 16 the metal plates may be trimmed for easy attachment of the respective wires 19 and 20 to the respective plates 23 and 24 at 21 and 22. The ends of the wires are stripped and soldered to the plate. If the plates are aluminum a brass tubular rivet may be inserted in the plate to both crimp and solder the wire to the contact plate.

If desired, the electric cord may be sealed in the side 16 after attachment to the contact plates (described below) is effected. The vinyl insulation of wires 19 and 20 are sealed at the inside of side 16 using solvent sealer such as the commercially available VC-2.

Only after wires 19 and 20 have been attached to the respective cleaned contact plates, and have been sealed into mat side 16, are the steps of attaching the separator buttons carried out. The lower plate is ground lightly at designated spots, using a template, and is then recleaned with denatured alcohol and dried with compressed air. INSTANT KRAZY GLUE adhesive is applied to the ground areas and pure gum rubber separator buttons 25 are immediately placed thereon. Rubber adhesive backed separator tape 26 is then applied completely around the outside edge of the bottom plate, with the exception of two 1/16 inch gaps 28 at end 16 six inches either side of the cord entry and two similar 1/16 inch gaps at the opposite end six inches either side of the center. For the moment the conventional paper backing (not shown) protecting the adhesive on the separator tape 26 is not removed. The bottom of the carpet is closed and the switch is tested electrically. If that test is successfully completed the adhesive on the separator tape 26 is exposed and the separator tape is permanently placed. The mat switch is then reclosed and the 45° cuts 29 on the three sides are welded, using coils of continuous welding cord preferably consisting of ⅛ inch 60 durometer PVC. We prefer a SEELYE brand electric plastic welder and Model 63 accessories. Preferably this leaves the weld extending above the surface, and this raised portion is smoothed in any appropriate manner. A carpenter's plane may be used. Heat and pressure such as a heated roller are then used to smooth the weld area completely. Preferably the carpet is then inflated with a hollow needle with dry nitrogen gas and then placed in water for inspection, and any defective areas are resealed. This step may be repeated as necessary until sealing is complete and the electrical test is satisfactory. The mat is deflated during the electrical test, and finally re-sealed with a plastic plug and plastisol heat cured as described when both leakage tests and electrical tests are passed.

It will be understood that although the steps herein have been described primarily with reference to present materials, other materials are possible. My invention is intended to be limited only by the claims.

I claim:

1. In a process for reconstructing a floor mat switch having contact plates, separators, and a plastic cover, the steps of (1) making a cut at a 45° angle to the mat surface in a manner so that the cut extends from the mat surface into the space between the contact plates, said cut extending on all sides of the mat which do not contain the electric contact cord,
(2) opening the mat about the remaining uncut side as a hinge to a maximum of 135°,
(3) cutting the electric cord flush with the inside and outside surfaces of the mat,
(4) removing all contents of the mat cover,
(5) cleaning the contact plates of all foreign matter,
(6) Drilling out the electric wires where they pass through the mat cover,
(7) threading new electric wire through a hole formed by the drilling out step and sealing the wire to the cover,
(8) attaching said electric wire to the contact plates,
(9) adhesively affixing separator buttons to the surface of a contact plate,
(10) adhesively affixing separator strips to the edge of the bottom plate leaving at least one gap in the separator strips at each of two opposed sides,
(11) replacing the contact plate with the associated separator buttons and strips in the mat cover, and
(12) completely sealing the cut in the cover.

2. The method of claim 1 in which the completed mat is tested by inflating it with nitrogen and placing it under water to determine where any leaks are so that they may be resealed.

3. The process of claim 1 in which the sealing step is carried out with an electric plastic welding tool and a continuous length of soft welding cord made of PVC plastic.

4. The process of claim 1 in which the cover is polyvinyl chloride and the new electric cord is insulated with polyvinyl chloride and is sealed into the opening formed by drilling out the old electric wire with a solvent effective on polyvinyl chloride, whereby the new cord becomes an integral part of the mat cover.

5. The process of claim 1 in which the weld is smoothed by the added steps of first cutting down the weld area until it is very nearly smooth, then heating and rolling the weld area until it is completely smooth.

6. The process of claim 1 including the additional step of painting the floor mat switch after all of the preceding steps.

7. The process of claim 1 in which the separator buttons are discs of pure gum rubber, and in which the contact plates are prepared by light grinding and by cleaning with denatured alcohol before adhering the separator buttons.

8. The device of claim 1 in which after the separator buttons are adhered to the bottom plate and after the new electrical connections are made to the bottom and top plates but before the separator strips are permanently adhered to the bottom plate the plates are assembled with the separator strips inside the mat frame and electrically tested for proper performance to insure that after final assembly the mat will work properly.

* * * * *